US009175242B2

(12) United States Patent
Radano et al.

(10) Patent No.: US 9,175,242 B2
(45) Date of Patent: Nov. 3, 2015

(54) FLUID HAVING IMPROVED LUBRICITY PROPERTIES

(75) Inventors: Christopher Paul Radano, West Chester, PA (US); Peter Moore, Glenside, PA (US); Mandi J. McElwain, Glenside, PA (US); Michael L. Alessi, Rose Valley, PA (US); Boris Eisenberg, Heppenheim (DE); Christoph Wincierz, Darmstadt (DE)

(73) Assignee: Evonik RohMax Additives GmbH, Darmstadt (DE)

( * ) Notice: Subject to any disclaimer, the term of this patent is extended or adjusted under 35 U.S.C. 154(b) by 0 days.

(21) Appl. No.: 13/318,492

(22) PCT Filed: Jun. 11, 2010

(86) PCT No.: PCT/EP2010/058241

§ 371 (c)(1),
(2), (4) Date: Nov. 2, 2011

(87) PCT Pub. No.: WO2010/142789

PCT Pub. Date: Dec. 16, 2010

(65) Prior Publication Data

US 2012/0053100 A1 Mar. 1, 2012

Related U.S. Application Data

(60) Provisional application No. 61/186,744, filed on Jun. 12, 2009.

(51) Int. Cl.

| | |
|---|---|
| ***C10M 173/02*** | (2006.01) |
| ***C10M 145/14*** | (2006.01) |
| ***C10M 169/04*** | (2006.01) |
| ***C10M 161/00*** | (2006.01) |

(52) U.S. Cl.

CPC ..... *C10M 169/041* (2013.01); *C10M 161/00* (2013.01); *C10M 2203/1006* (2013.01); *C10M 2203/1065* (2013.01); *C10M 2205/0206* (2013.01); *C10M 2207/28* (2013.01); *C10M 2207/282* (2013.01); *C10M 2207/2805* (2013.01); *C10M 2207/2825* (2013.01); *C10M 2209/084* (2013.01); *C10N 2220/021* (2013.01); *C10N 2230/02* (2013.01)

(58) Field of Classification Search

CPC ..... C10M 2203/1006; C10M 2209/084; C10M 2207/28

USPC ..... 508/474, 469

See application file for complete search history.

(56) References Cited

U.S. PATENT DOCUMENTS

| | | | | |
|---|---|---|---|---|
| 4,956,122 | A | 9/1990 | Watts et al. | |
| 5,047,457 | A | 9/1991 | Higgins | |
| 5,883,057 | A | 3/1999 | Roell et al. | |
| 6,303,548 | B2 | 10/2001 | Gao | |
| 8,067,349 | B2 | 11/2011 | Stoehr et al. | |
| 2001/0056045 | A1* | 12/2001 | Lal | 508/491 |
| 2005/0023504 | A1* | 2/2005 | Placek et al. | 252/73 |
| 2006/0189490 | A1 | 8/2006 | Dardin et al. | |
| 2007/0197409 | A1 | 8/2007 | Scherer et al. | |
| 2007/0213237 | A1 | 9/2007 | Scherer et al. | |
| 2007/0219101 | A1 | 9/2007 | Scherer et al. | |
| 2008/0146475 | A1 | 6/2008 | Mueller et al. | |
| 2009/0048406 | A1 | 2/2009 | Iroff et al. | |
| 2009/0064568 | A1 | 3/2009 | Stohr et al. | |
| 2010/0167970 | A1 | 7/2010 | Stoehr et al. | |
| 2010/0190671 | A1 | 7/2010 | Stoehr et al. | |
| 2011/0237473 | A1 | 9/2011 | Stoehr et al. | |

FOREIGN PATENT DOCUMENTS

| | | | |
|---|---|---|---|
| CN | 101142303 | A | 3/2008 |
| EP | 0 992 570 | A2 | 4/2000 |
| GB | 857 180 | | 12/1960 |
| GB | 1 420 824 | | 1/1976 |
| JP | 2627725 | | 7/1997 |
| JP | 2006-77119 | | 3/2006 |
| JP | 2006124609 | A | 5/2006 |
| JP | 2007 031666 | | 2/2007 |
| SU | 464127 | | 3/1975 |
| WO | WO2009072524 | A1 | 6/2009 |

OTHER PUBLICATIONS

U.S. Appl. No. 13/576,098, filed Jul. 30, 2012, Langston, et al.
U.S. Appl. No. 13/636,034, filed Sep. 19, 2012, Ghahary, et al.
U.S. Appl. No. 13/202,744, filed Aug. 22, 2011, Eisenberg, et al.
U.S. Appl. No. 13/255,218, filed Sep. 7, 2011, Eisenberg, et al.
U.S. Appl. No. 61/393,076, filed Oct. 14, 2010, Langston, et al.
U.S. Appl. No. 61/421,867, filed Dec. 10, 2010, Radano, et al.
U.S. Appl. No. 61/527,800, filed Aug. 26, 2011, McElwain, et al.
U.S. Appl. No. 61/408,274, filed Oct. 29, 2010, Neveu, et al.
U.S. Appl. No. 61/421,876, filed Dec. 10, 2010, Radano.
U.S. Appl. No. 61/421,870, filed Dec. 10, 2010, Radano.
International Search Report Issued Aug. 5, 2010 in PCT/EP10/058241 Filed Jun. 11, 2010
Office Action issued Aug. 18, 2014, in Russian Patent Application No. 2012100237/04(000365) (with English-language Translation).
Office Action issued Apr. 15, 2014, in Russian Patent Application No. 2012100237/04(000365) (with English-language Translation).
Notification of Reasons for Refusal issued Feb. 12, 2014, in Japanese Application No. 2012-514482, filed Jun. 11, 2010 (with English-language Translation).

* cited by examiner

*Primary Examiner* — Vishal Vasisth
(74) *Attorney, Agent, or Firm* — Oblon, McClelland, Maier & Neustadt, L.L.P.

(57) ABSTRACT

A lubricant which contains an ester oil and a polyalkyl(meth) acrylate copolymer having in copolymerized form a $C_1$-$C_4$ alkyl(meth)acrylate, and a $C_4$-$C_{4000}$ alkyl(meth)acrylate exhibits an improved Viscosity Index compared to a lubricant having no ester oil.

11 Claims, No Drawings

FLUID HAVING IMPROVED LUBRICITY PROPERTIES

This application is a 371 of PCT/EP2010/058241, filed Jun. 11, 2010, which claims benefit of 61/186,744, filed Jun. 12, 2009.

BACKGROUND OF THE INVENTION

1. Field of the Invention

The present invention relates to a hydrocarbon oil based lubricant comprising a combination of a polar polyalkyl (meth)acrylate copolymer and an ester oil.

2. Description of the Related Art

For more than 50 years, the lubricant industry has sought efficient ways to modify the viscosity of various fluids to improve the overall lubricity of the fluid for applications in crankcase fluids, transmission fluids, gear oils, and hydraulic oils. The viscosity index (VI) of a fluid, refers to the ability for a fluid to maintain viscosity and lubricity over a specified temperature range, most often between 40° C. and 100° C. Increasing the VI of a fluid not only leads to enhanced lubrication, but also can provide additional benefits and utilities which may distinguish the overall performance of one fluid versus another. Such benefits may include reduced viscosities at colder temperatures thus improving low temperature performance and improvements in hydraulic pump efficiency for various hydraulic systems, which can ultimately lead to reduced fuel consumption.

The conventional base fluids for lubricants are mineral base oils (Groups I-III), synthetic oils such as poly alpha-olefins (Group IV) or ester oils (Group V). For the purposes of the present invention the term hydrocarbon oils will be understood to describe both mineral oils (Groups I-III) and poly alpha-olefins (Group IV). The viscosity index of these base fluids generally increases as the fluid changes from a Group I to Group V. Synthetic base fluids (Groups IV-V) are beneficial for their favorable low temperature properties and their high viscosity index.

The viscosity index of a lubricant formulation may be modified by addition of a viscosity modifier or by altering the composition of the base fluid. Viscosity modifiers may conventionally be selected from polymers such as polyolefins and polymethacrylates. Poly(alkylmethacrylates) (PAMAs) are conventionally employed as VI improvers to obtain favorable viscosity profiles in lubricating oils at high and low temperature. Chemical modification of poly(alkylmethacrylates), such as, for example, compositional modifications, molecular weight/shear stability adjustments and solvent selection may affect performance of the polymer as a VI improver in a lubricant composition.

Due to ever increasing demands on lubricants, in particular, hydrocarbon oil based lubricants, for better performance which would contribute to reduced fuel consumption and reduced frictional wear leading to increased engine or pump performance lifetime, the industry is continuously exploring new methods and technologies to improve lubricant performance and increase the VI of the lubricant formulation. The need for increasing viscosity index is important for many applications requiring lubrication, where incremental increases can result in vast improvements in performance and efficiency.

JP2007031666 describes methacrylate-based VI improvers prepared in a solvent such as ester-oil synthetic solvent, which increase the VI of ester-based synthetic fluids. The described viscosity index improvers, contain a copolymer (A) comprising alkyl(meth)acrylate(a1) selected from group consisting of $C_{1-4}$ alkyl and $C_{1-4}$ hydroxyalkyl(meth)acrylate ester, $C_{11-15}$ alkyl(meth)acrylate ester(a2), and $C_{16-24}$ alkyl (meth)acrylate ester(a3). A solvent (D) may be an aliphatic solvent, aromatic solvent or ester based synthetic oil.

JP2007031666 provides no indication that the copolymers are useful for improving the VI of hydrocarbon oil-based formulations.

JP 2006077119 reports the use of various ester oils which are used as solvents for synthetic base fluids. These ester-based synthetic fluids have benefits in low temperature viscosity, gear lubricity, and hydraulic actuation. However, there is no disclosure or suggestion of improvement in viscosity index of the final fluid.

JP 2627725 describes the synthesis of ethylene-alpha-olefin-MA based copolymers which may contain grafted side-chains and VI improvers containing the copolymers. The VI improvers are added to lubricating oils based on mineral oil, synthetics, ester-based synthetics and mixtures thereof.

U.S. Pat. No. 6,303,548 describes a lubrication oil which is a combination of a mineral basestock, a poly-alpha-olefin and a synthetic ester. A broad range of potential viscosity improvers which are prepared in a solvent is described. Potential viscosity modifiers in this crankcase application include alkyl methacrylate copolymers, olefin copolymers and poly-hydrogenated butadienes.

EP 992570 A3 describes a hydraulic lubrication oil containing one of a mineral oil, poly-alpha-olefin or ester based synthetic as a base fluid. EP 992570 A3 provides no discussion of VI benefit or notable low temperature benefit by addition of ester oil as an additive.

None of the above patents discloses or suggests that improvement in the VI of a hydrocarbon oil based lubricant can be obtained with a combination of copolymer having a polar composition and an ester oil.

DETAILED DESCRIPTION OF THE INVENTION

It is an object of the present invention to provide a lubricant composition having significantly improved lubricity. This and other objects have been achieved by the present invention, the first embodiment of which includes a lubricant, comprising:

an ester oil; and a polyalkyl(meth)acrylate copolymer comprising in copolymerized form a $C_1$-$C_4$ alkyl(meth)acrylate, preferably a $C_1$-$C_3$ alkyl (meth)acrylate and a $C_4$-$C_{4000}$ alkyl(meth)acrylate.

Polyalkyl(meth)acrylate polymers are polymers comprising units being derived from alkyl(meth)acrylate monomers. The term (meth)acrylates includes methacrylates and acrylates as well as mixtures thereof. These monomers are well known in the art.

In another embodiment, the present invention provides a lubricant comprising:

an ester oil; and a polyalkyl(meth)acrylate copolymer comprising in copolymerized from a $C_1$-$C_3$ alkyl(meth)acrylate, and a $C_4$-$C_{30}$ alkyl(meth)acrylate.

In a further embodiment, the present invention provides a lubricant comprising:

an ester oil; and a polyalkylmethacrylate copolymer comprising in copolymerized form a $C_1$-$C_4$ alkyl methacrylate, and a $C_4$-$C_{30}$ alkyl methacrylate.

In another embodiment, the present invention provides a lubricant comprising:

a hydrocarbon oil base;

a viscosity index improver; and an ester oil;

wherein the viscosity index improver comprises a polyalkylmethacrylate copolymer which comprises in copolymerized form a $C_1$-$C_4$ alkyl methacrylate; and a $C_4$-$C_{22}$ alkyl methacrylate.

In one embodiment, instead of methacrylates, acrylates are used or mixtures of methacrylates and acrylates. If acrylates are used, the amounts as given below for methacrylates apply as well.

The $C_{1-3}$ alkyl methacrylates may include methyl methacrylate, ethyl methacrylate, n-propyl methacrylate and isopropyl methacrylate and mixtures thereof. Methyl methacrylate is particularly preferred.

The $C_4$-$C_{4000}$ alkyl(meth)acrylate, preferably the $C_4$-$C_{400}$ alkyl(meth)acrylate, more preferably $C_4$-$C_{30}$ alkyl methacrylate may include n-butyl(meth)acrylate, tert-butyl(meth) acrylate and pentyl(meth)acrylate, hexyl(meth)acrylate, 2-ethylhexyl(meth)acrylate, heptyl(meth)acrylate, 2-tert-butylheptyl(meth)acrylate, octyl(meth)acrylate, 3-isopropylheptyl(meth)acrylate, nonyl(meth)acrylate, decyl(meth) acrylate, undecyl(meth)acrylate, 5-methylundecyl(meth) acrylate, dodecyl(meth)acrylate, 2-methyldodecyl(meth) acrylate, tridecyl(meth)acrylate, 5-methyltridecyl(meth) acrylate, tetradecyl(meth)acrylate, pentadecyl(meth) acrylate, hexadecyl(meth)acrylate, 2-methylhexadecyl (meth)acrylate, heptadecyl(meth)acrylate, 5-isopropylheptadecyl(meth)acrylate, 4-tert-butyloctadecyl (meth)acrylate, 5-ethyloctadecyl(meth)acrylate, 3-isopropyloctadecyl(meth)acrylate, octadecyl(meth)acrylate, nonadecyl(meth)acrylate, eicosyl(meth)acrylate, cetyleicosyl(meth) acrylate, stearyleicosyl(meth)acrylate, docosyl(meth) acrylate and/or eicosyltetratriacontyl(meth)acrylate and mixtures thereof. Preferred $C_4$-$C_{30}$ alkyl methacrylates are n-butyl(meth)acrylate, dodecyl(meth)acrylate, 5-methyltridecyl(meth)acrylate, tetradecyl(meth)acrylate and mixtures thereof.

In addition thereto, the $C_4$-$C_{4000}$ alkyl(meth)acrylate monomers, preferably the $C_4$-$C_{400}$ alkyl(meth)acrylate monomers include polyolefin-based macromonomers. The polyolefin-based macromonomers comprise at least one group which is derived from polyolefins. Polyolefins are known in the technical field, and can be obtained by polymerizing alkenes and/or alkadienes which consist of the elements carbon and hydrogen, for example $C_2$-$C_{10}$-alkenes such as ethylene, propylene, n-butene, isobutene, norbornene, and/or $C_4$-$C_{10}$-alkadienes such as butadiene, isoprene, norbornadiene. The polyolefin-based macromonomers comprise preferably at least 70% by weight and more preferably at least 80% by weight and most preferably at least 90% by weight of groups which are derived from alkenes and/or alkadienes, based on the weight of the polyolefin-based macromonomers. The polyolefinic groups may in particular also be present in hydrogenated form. In addition to the groups which are derived from alkenes and/or alkadienes, the alkyl(meth)acrylate monomers derived from polyolefin-based macromonomers may comprise further groups. These include small proportions of copolymerizable monomers. These monomers are known per se and include, among other monomers, alkyl (meth)acrylates, styrene monomers, fumarates, maleates, vinyl esters and/or vinyl ethers. The proportion of these groups based on copolymerizable monomers is preferably at most 30% by weight, more preferably at most 15% by weight, based on the weight of the polyolefin-based macromonomers. In addition, the polyolefin-based macromonomers may comprise start groups and/or end groups which serve for functionalization or are caused by the preparation of the polyolefin-based macromonomers. The proportion of these start groups and/or end groups is preferably at most 30% by weight, more preferably at most 15% by weight, based on the weight of the polyolefin-based macromonomers.

The number-average molecular weight of the polyolefin-based macromonomers is preferably in the range from 500 to 50000 g/mol, more preferably from 700 to 10000 g/mol, in particular from 1500 to 8000 g/mol and most preferably from 2000 to 6000 g/mol.

In the case of preparation of the comb polymers via the copolymerization of low molecular weight and macromolecular monomers, these values arise through the properties of the macromolecular monomers. In the case of polymer-analogous reactions, this property arises, for example, from the macroalcohols and/or macroamines used taking account of the converted repeat units of the main chain. In the case of graft copolymerizations, the proportion of polyolefins formed which have not been incorporated into the main chain can be used to conclude the molecular weight distribution of the polyolefin.

The polyolefin-based macromonomers preferably have a low melting point, which is measured by means of DSC. The melting point of the polyolefin-based macromonomers is preferably less than or equal to −10° C., especially preferably less than or equal to −20° C., more preferably less than or equal to −40° C. Most preferably, no DSC melting point can be measured for the repeat units which are derived from the polyolefin-based macromonomers in the polyalkyl(meth) acrylate copolymer.

Polyolefin-based macromonomers are disclosed in the publications DE 10 2007 032 120 A1, filed 09, Jul. 2007 at the German Patent Office (Deutsches Patentamt) having the application number DE102007032120.3; and DE 10 2007 046 223 A1, filed 26, Sep. 2007 at the German Patent Office (Deutsches Patentamt) having the application number DE 102007046223.0; which documents are enclosed herein by reference.

The methacrylate monomers may be branched or linear.

Without intending any limitation by the following description, the alkyl(meth)acrylate polymers exhibit a polydispersity, given by the ratio of the weight average molecular weight to the number average molecular weight Mw/Mn, in the range of 1 to 15, preferably 1.1 to 10, especially preferably 1.2 to 5. According to a special embodiment, the polydispersity is preferably situated in the range of 1.01 to 3.0, more preferably 1.05 to 2.0, especially preferred in the range of 1.1 to 1.8 and most preferred in the range of 1.15 to 1.6. The polydispersity may be determined by gel permeation chromatography (GPC).

The weight average molecular weight of the polyalkyl (meth)acrylate copolymer is in the range from 5,000 to 1,000,000, preferably 20,000 to 500,000, more preferably 25,000 to 160,000.

Preferably, the polyalkyl(meth)acrylate copolymer may comprise a Chi parameter in the range from 0.28 to 0.65, more preferably in the range from 0.3 to 0.55 and most preferably in the range from 0.35 to 0.5. The Chi ($\chi$) parameter is well known in the art and describes the solubility of the polymers. The calculation of the Chi parameter is based on the Hoy method. Useful information are provided in Polymer Handbook ($4^{th}$ Edition, Editors. Bransdrup, Immergut, Grulke, 1999, VII/675). The values can easily be calculated based on the following formulae exemplifying a copolymer comprising two or three monomers:

$$\text{Chi}(A/B)=[\text{wt. fraction } A(\text{delta } A-\text{delta solvent})^2+\text{wt. fraction } B(\text{delta } B-\text{delta solvent})^2-\text{wt. fraction } A\times\text{wt. fraction } B(\text{delta } A-\text{delta } B)^2]/6$$

$$\text{Chi}(A/B/C)=[\text{wt. fraction } A(\text{delta } A-\text{delta solvent})^2+\text{wt. fraction } B(\text{delta } B-\text{delta solvent})^2+\text{wt. fraction } C(\text{delta } C-\text{delta solvent})^2-\text{wt. fraction } A\times\text{wt. fraction } B(\text{delta } A-\text{delta } B)^2-\text{wt. fraction } A\times\text{wt. fraction } C(\text{delta } A-\text{delta } C)^2-\text{wt. fraction } B\times\text{wt. fraction } C(\text{delta } B-\text{delta } C)^2]/6$$

The delta values for the monomers A, B and C, respectively are provided by the reference mentioned above or can easily be calculated using the group addition rules such as in the method of Hoy described in Krevelen D. W. Van, Properties of Polymers, published by Elsevier, 3rd completely revised edition, 1990; K. L. Hoy, J. Paint Technol. 42, 76 (1970) and Polymer Handbook (4th Edition, Editors, Bransdrup, Immergut, Grulke, 1999, VII/675), especially on Table 2, page 684 (Hoy).

The delta value for the solvent can preferably be assumed to be the delta value of isooctane and calculated to be 6.8 $cal^{1/2}\ cm^{-3/2}$. The previously mentioned interaction parameter Chi correlates to the Hildebrand solubility parameter through an extensive and detailed derivation of the following equation:

$$\text{Chi}=V(\delta_a-\delta_s)^2/RT$$

$$\chi_{12}=V_{seg}(\delta_a-\delta_b)^2/RT$$

The Hildebrand solubility parameter can be used as a useful guide to determine the solubility of polymers in a specific medium. A detailed summary of this parameter is provided in the chapter entitled "Solubility Parameter Values", by E. A. Grulke in the Polymer Handbook, Fourth Edition, ed. J. Brandrup, E. J. Immergut, and E. A. Grulke, John Wiley & Sons, New York, 1999.

According to a preferred aspect of the present invention, the polyalkyl(meth)acrylate polymers useful for the present invention may comprise units being derived from one or more alkyl(meth)acrylate monomers of formula (I)

(I)

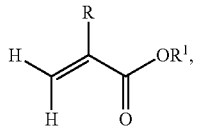

where R is hydrogen or methyl, $R^1$ means a linear, branched or cyclic alkyl residue with 1 to 4 carbon atoms, especially 1 to 3 and preferably 1 to 2 carbon atoms.

Examples of monomers according to formula (I) are, among others, (meth)acrylates which derived from saturated alcohols such as methyl(meth)acrylate, ethyl(meth)acrylate, n-propyl(meth)acrylate, isopropyl(meth)acrylate, n-butyl (meth)acrylate, and tert-butyl(meth)acrylate. Preferably, the polymer comprises units being derived from methyl methacrylate.

The polyalkyl(meth)acrylate polymers useful for the present invention may comprise 0.1 to 40% by weight, preferably 0.5 to 35% by weight, in particular 10 to 30% by weight of units derived from one or more alkyl(meth)acrylate monomers of formula (I) based on the total weight of the polymer.

In another embodiment, the polyalkyl(meth)acrylate polymers useful for the present invention may preferably comprise at least 5% by weight, in particular at least 10% by weight, more preferably at least 15% by weight and most preferably at least 20% by weight of units derived from one or more alkyl(meth)acrylate monomers having 1 to 4 carbon atoms, especially 1 to 3 and preferably 1 to 2 carbon atoms in the alkyl residue, preferably methyl(meth)acrylate.

The polyalkyl(meth)acrylate polymer may be obtained preferably by free-radical polymerization. Accordingly the weight fraction of the units of the polyalkyl(meth)acrylate polymer as mentioned in the present application is a result of the weight fractions of corresponding monomers that are used for preparing the polymer.

Preferably, the polyalkyl(meth)acrylate polymer comprises units of one or more alkyl(meth)acrylate monomers of formula (II)

(II)

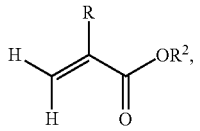

where R is hydrogen or methyl, $R^2$ means a linear, branched or cyclic alkyl residue with 4 to 15, preferably 5 to 15 and more preferably 6 to 15 carbon atoms.

Examples of component (II) include (meth)acrylates that derive from saturated alcohols as mentioned above.

The polyalkyl(meth)acrylate polymer preferably comprises at least 0.05% by weight, particularly at least 10% by weight, especially at least 20% by weight of units derived from one or more alkyl(meth)acrylates of formula (II), based on the total weight of the polymer. According to a preferred aspect of the present invention, the polymer comprises preferably about 25 to 99.5% by weight, more preferably about 70 to 95% by weight of units derived from monomers according to formula (II).

Furthermore, the polyalkyl(meth)acrylate polymers useful for the present invention may comprise units being derived from one or more alkyl(meth)acrylate monomers of formula (III)

(III)

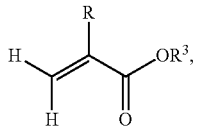

where R is hydrogen or methyl, $R^3$ means a linear, branched or cyclic alkyl residue with 16-4000 carbon atoms, preferably 16 to 400 carbon atoms and more preferably 16 to 30 carbon atoms.

Examples of component (III) include (meth)acrylates which derive from saturated alcohols as mentioned above.

The polyalkyl(meth)acrylate polymers useful for the present invention may comprise 0 to 99.9% by weight, preferably 0.1 to 80% by weight, in particular 0.5 to 70% by weight of units derived from one or more alkyl(meth)acrylate monomers of formula (III) based on the total weight of the polymer.

According to a special aspect of the present invention, the weight ratio of ester compounds of the formula (II) which contain 7 to 15 carbon atoms in the alcohol radical to the ester compounds of the formula (III) which contain 16 to 4000 carbon atoms in the alcohol radical is preferably in the range of 100:1 to 1:100, more preferably in the range of 50:1 to 2:1, especially preferably 10:1 to 5:1.

The embodiment having a low amount of long chain alkyl residues (16 to 4000) is preferably combined with a low amount of C1 to C4 alkyl(meth)acrylates. Such embodiment comprises improved low temperature performance.

According to a further aspect of the present invention, the weight ratio of ester compounds of the formula (II) which contain 7 to 15 carbon atoms in the alcohol radical to the ester compounds of the formula (III) which contain 16 to 4000 carbon atoms in the alcohol radical is preferably in the range of 1000:1 to 1:1000, more preferably in the range of 2:1 to 1:500, especially preferably 1:2 to 1:100.

The embodiment having a high amount of long chain alkyl residues (16 to 4000) is preferably combined with a high amount of C1 to C4 alkyl(meth)acrylates. Such embodiment comprises improved VI performance.

The ester compounds with a long-chain alcohol residue, especially monomers according to formulae (II) and (III), can be obtained, for example, by reacting (meth)acrylates and/or the corresponding acids with long chain fatty alcohols, where in general a mixture of esters such as (meth)acrylates with different long chain alcohol residues results. These fatty alcohols include, among others, Oxo Alcohol® 7911 and Oxo Alcohol® 7900, Oxo Alcohol® 1100 (Monsanto); Alphanol® 79 (ICI); Nafol® 1620, Alfol® 610 and Alfol® 810 (Sasol); Epal® 610 and Epal® 810 (Ethyl Corporation); Linevol® 79, Linevol® 911 and Dobanol® 25L (Shell AG); Lial 125 (Sasol); Dehydad® and Dehydad® and Lorol® (Cognis).

The polymer may contain units derived from comonomers as an optional component.

These comonomers include hydroxyalkyl(meth)acrylates like 3-hydroxypropyl(meth)acrylate, 3,4-dihydroxybutyl (meth)acrylate, 2-hydroxyethyl(meth)acrylate, 2-hydroxypropyl(meth)acrylate, 2,5-dimethyl-1,6-hexanediol(meth) acrylate, 1,10-decanediol(meth)acrylate;

aminoalkyl(meth)acrylates and aminoalkyl(meth)acrylamides like N-(3-dimethylaminopropyl)methacrylamide, 3-diethylaminopentyl(meth)acrylate, 3-dibutylaminohexadecyl(meth)acrylate; nitriles of (meth)acrylic acid and other nitrogen-containing (meth)acrylates like N-(methacryloyloxyethyl)diisobutylketimine, N-(methacryloyloxyethyl)dihexadecylketimine, (meth)acryloylamidoacetonitrile, 2-methacryloyloxyethylmethylcyanamide, cyanomethyl (meth)acrylate;

aryl(meth)acrylates like benzyl(meth)acrylate or phenyl (meth)acrylate, where the acryl residue in each case can be unsubstituted or substituted up to four times;

carbonyl-containing (meth)acrylates like 2-carboxyethyl (meth)acrylate, carboxymethyl(meth)acrylate, oxazolidinylethyl(meth)acrylate, N-methyacryloyloxy)formamide, acetonyl(meth)acrylate, N-methacryloylmorpholine, N-methacryloyl-2-pyrrolidinone, N-(2-methyacryloxyoxyethyl)-2-pyrrolidinone, N-(3-methacryloyloxypropyl)-2-pyrrolidinone, N-(2-methyacryloyloxypentadecyl(-2-pyrrolidinone, N-(3-methacryloyloxyheptadecyl-2-pyrrolidinone;

(meth)acrylates of ether alcohols like tetrahydrofurfuryl (meth)acrylate, methoxyethoxyethyl(meth)acrylate, 1-butoxypropyl(meth)acrylate, cyclohexyloxyethyl(meth)acrylate, propoxyethoxyethyl(meth)acrylate, benzyloxyethyl (meth)acrylate, furfuryl(meth)acrylate, 2-butoxyethyl(meth) acrylate, 2-ethoxy-2-ethoxyethyl(meth)acrylate, 2-methoxy-2-ethoxypropyl(meth)acrylate, ethoxylated(meth)acrylates, 1-ethoxybutyl(meth)acrylate, methoxyethyl(meth)acrylate, 2-ethoxy-2-ethoxy-2-ethoxyethyl(meth)acrylate, esters of (meth)acrylic acid and methoxy polyethylene glycols;

(meth)acrylates of halogenated alcohols like 2,3-dibromopropyl(meth)acrylate, 4-bromophenyl(meth)acrylate, 1,3-dichloro-2-propyl(meth)acrylate, 2-bromoethyl(meth) acrylate, 2-iodoethyl(meth)acrylate, chloromethyl(meth) acrylate;

oxiranyl(meth)acrylate like 2,3-epoxybutyl(meth)acrylate, 3,4-epoxybutyl(meth)acrylate, 10,11 epoxyundecyl (meth)acrylate, 2,3-epoxycyclohexyl(meth)acrylate, oxiranyl(meth)acrylates such as 10,11-epoxyhexadecyl(meth) acrylate, glycidyl(meth)acrylate;

heterocyclic(meth)acrylates like 2-(1-imidazolyl)ethyl (meth)acrylate, 2-(4-morpholinyl)ethyl meth)acrylate and 1-(2-methacryloyloxyethyl)-2-pyrrolidone;

maleic acid and maleic acid derivatives such as mono- and diesters of maleic acid, maleic anhydride, methylmaleic anhydride, maleinimide, methylmaleinimide;

fumaric acid and fumaric acid derivatives such as, for example, mono- and diesters of fumaric acid;

vinyl halides such as, for example, vinyl chloride, vinyl fluoride, vinylidene chloride and vinylidene fluoride;

vinyl esters like vinyl acetate;

vinyl monomers containing aromatic groups like styrene, substituted styrenes with an alkyl substituent in the side chain, such as α-methylstyrene and α-ethylstyrene, substituted styrenes with an alkyl substituent on the ring such as vinyltoluene and p-methylstyrene, halogenated styrenes such as monochlorostyrenes, dichlorostyrenes, tribromostyrenes and tetrabromostyrenes;

heterocyclic vinyl compounds like 2-vinylpyridine, 3-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, 2-methyl-1-vinylimidazole, N-vinylpyrrolidone, 2-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles;

vinyl and isoprenyl ethers;

methacrylic acid and acrylic acid.

The comonomers and the ester monomers of the formulae (I), (II) and (III) can each be used individually or as mixtures.

The proportion of comonomers can be varied depending on the use and property profile of the polymer. In general, this proportion may be in the range from 0 to 60% by weight, preferably from 0.01 to 20% by weight and more preferably from 0.1 to 10% by weight. Owing to the combustion properties and for ecological reasons, the proportion of the monomers which comprise aromatic groups, heteroaromatic groups, nitrogen-containing groups, phosphorus-containing groups and sulphur-containing groups should be minimized. The proportion of these monomers can therefore be restricted to 1% by weight, in particular 0.5% by weight and preferably 0.01% by weight.

In one embodiment, the copolymer is obtained by polymerization in the presence of an ester oil, a mineral oil or a combination thereof.

In one embodiment, unexpectedly, the combination of a small amount of ester oil with a polar-monomer containing polymer, such as an MMA-containing PAMA, shows a significantly higher VI in a non-polar solvent, such as mineral oil, than the same polymer-oil combination in the absence of the ester oil. Additionally, in one embodiment, this advantage can be captured by using the ester oil as a solvent in the preparation of a polymer that will subsequently be diluted in a lubricant formulation.

In one embodiment, the present invention describes how the viscosity index of a fully formulated lubricant can be enhanced by exploiting synergistic effects between a polar ester oil and a viscosity index improver which comprises polar comonomer units. The expression "polar" should be understood in a way that a homopolymer derived from the polar monomer alone would not be soluble in the lubricating oil.

Within the context of the present invention, all ranges below include explicitly all subvalues between the upper and lower limits.

In one embodiment, the polyalkylmethacrylate copolymer is obtained in the presence of the ester oil, a hydrocarbon oil or a mixture thereof, preferably the polymer is obtained in the presence of an ester oil.

The ester oil is not particularly limited. The ester oil include in particular phosphoric esters, esters of dicarboxylic acids, esters of monocarboxylic acids with diols or polyalkylene glycols, esters of neopentylpolyols with monocarboxylic acids (cf. Ullmanns Encyclopädie der Technischen Chemie [Ullmann's Encyclopaedia of Industrial Chemistry], 3rd edition, Vol. 15, pages 287-292, Urban & Schwarzenberg (1964)). Suitable esters of dicarboxylic acids are firstly the esters of phthalic acid, in particular the phthalic esters with $C_4$ to $C_8$-alcohols, dibutyl phthalate and dioctyl phthalate being mentioned in particular, and secondly the esters of aliphatic dicarboxylic acids, in particular the esters of straight-chain dicarboxylic acids with branched primary alcohols. The esters of sebacic, of adipic and of azelaic acid are singled out in particular, and in particular the 2-ethylhexyl and isooctyl-3,5,5-trimethyl esters and the esters with the $C_8$-, $C_9$- and $C_{10}$-oxo alcohols should be mentioned.

The esters of straight-chain primary alcohols with branched dicarboxylic acids are particularly important. Alkyl-substituted adipic acid, for example 2, 2,4-trimethyladipic acid, may be mentioned as examples.

Preferred esters have (oligo)oxyalkyl groups in the alcohol radical. These include in particular ethylene glycol and propylene glycol groups.

The diesters with diethylene glycol, triethylene glycol, tetraethylene glycol to decamethylene glycol and furthermore with dipropylene glycol as alcohol component may be singled out as esters of monocarboxylic acids with diols or polyalkylene glycols. Propionic acid, (iso)butyric acid and pelargonic acid may be mentioned specifically as monocarboxylic acids—for example, dipropylene glycol pelargonate, diethylene glycol dipropionate and diisobutyrate and the corresponding esters of triethylene glycol, and tetraethylene glycol di-2-ethylhexanoate, being mentioned.

Preferably, the ester oil includes dicarboxylic acid esters and mixtures thereof, di-alkyl-adipates and mixtures thereof, dialkyl substituted sebacates and mixtures thereof, alkyl methacrylates and mixtures thereof. The ester oil is preferably a dialkyl dicarboxylate, an alkyl methacrylate or a mixture thereof. The dialkyl dicarboxylate is at least one selected from the group consisting of a dialkyl adipate, a dialkyl pimelate, a dialkyl suberate, a dialkyl azelate, a dialkyl sebacate and mixtures thereof.

These esters are used individually or as a mixture.

Preferably, the weight ratio of said polyalkyl(meth)acrylate copolymer to said ester oil is in the range of 10:1 to 1:10, more preferably 5:1 to 1:5.

The amount of the ester oil is 0.5 wt % to 80 wt % based on the total amount of the lubricant, preferably 0.75 to 40 wt. %, more preferably 5 to 35 wt %.

In one embodiment, the lubricant contains a hydrocarbon oil, preferably a mineral oil of Groups I, II or III or a polyalpha olefin of Group IV of the API groups, which are discussed in more detail below.

The amount of the hydrocarbon oil is >0 to 99 wt % based on the total weight of the lubricant, preferably 0.5 to 95 wt %. The amount of polyalkyl(meth)acrylate, preferably polyalkylmethacrylate copolymer is 0.5 to 40 wt % based on the total weight of said lubricant, preferably 5 to 35 wt %.

Preferably, the weight ratio of said polyalkyl(meth)acrylate copolymer to said hydrocarbon oil is in the range of 1:1 to 1:100, more preferably 1:3 to 1:50.

In a preferred embodiment, the weight ratio of said ester oil to said hydrocarbon oil preferably is in the range of 1:1 to 1:100, more preferably 1:3 to 1:20.

The amount of the monomer mixture of the $C_1$-$C_3$ alkyl methacrylate is in the range from 0.5 to 40%, based on the total weight of the monomer mixture; and the amount of the monomer mixture of the $C_4$-$C_{22}$ alkyl methacrylate is in the range from 60 to 99.5% based on the total weight of the monomer mixture. In one embodiment, the lower alkyl methacrylate includes $C_1$-$C_4$ (in the amount given above for $C_1$ to $C_3$) and the higher alkyl methacrylate includes $C_4$-$C_{30}$ (in the amounts as given above for $C_4$ to $C_{30}$). The $C_4$ in lower alkyl methacrylate and the higher alkyl methacrylate may be the same or different.

The monomer mixture may further comprise a nonpolar monomer which can be copolymerized with the $C_1$-$C_3$ (or $C_1$-$C_4$) alkyl methacrylate and $C_4$-$C_{30}$ alkyl methacrylate.

In one embodiment, a comonomer is styrene which may be substituted or unsubstituted. In addition, polymeric methacrylate monomers such as the pHBD-methacrylate may be used.

In one embodiment of the present invention, the amount of the monomer mixture of the $C_1$-$C_4$ alkyl(meth)acrylate preferably is in the range from 0.5 to 40%, based on the total weight of the monomer mixture; and an amount of the monomer mixture of the $C_4$-$C_{4000}$ alkyl (meth)acrylate preferably is in the range from 60 to 99.5% based on the total weight of the monomer mixture.

In a further embodiment of the present invention, the amount of the monomer mixture of the $C_1$-$C_4$ alkyl methacrylate preferably is in the range from 0.5 to 40%, based on the total weight of the monomer mixture; and an amount of the monomer mixture of the $C_4$-$C_{30}$ alkyl methacrylate preferably is in the range from 60 to 99.5% based on the total weight of the monomer mixture.

The architecture of the ester-comprising polymers is not critical for many applications according to the present invention. Accordingly, the copolymers may be random copolymers, gradient copolymers, block copolymers, graft copolymers or mixtures of these.

Block copolymers and gradient copolymers can be obtained, for example, by altering the monomer composition discontinuously during the chain growth.

The present invention also provides a method for preparing a lubricant, comprising polymerizing a monomer mixture comprising a $C_1$-$C_3$ (or $C_1$ to $C_4$) alkyl methacrylate, and a $C_4$-$C_{22}$ (or $C_4$ to $C_{30}$) alkyl methacrylate, in the presence of an ester oil, a hydrocarbon oil or a mixture thereof.

Surprisingly, in one embodiment, a synergistic improvement in lubricity as indicated by increase in the Viscosity Index (VI) of the lubricant is obtained when a hydrocarbon oil based lubricant comprises a combination of the above described copolymer prepared from a monomer mixture comprising 0.5 to 40 percent by weight relative to the total monomer weight of a $C_1$-$C_4$ alkyl methacrylate and a Group V ester oil.

In one embodiment, the present invention provides a formulation which may attain higher viscosity indices while maintaining polymer solubility in the lubricating oil.

Preferably, the lubricant is based on mineral oil from API Groups I, II, III and/or IV or mixtures of these. According to a preferred embodiment of the present invention, a mineral oil containing at least 90% by weight saturates and at most about 0.03% sulfur measured by elemental analysis is used.

Group I oils include RMF 5, Sun SN100, KPE. Group II oils include P1017 or Petro-Canada 1017. Group III oils include Nexbase 3020, Nexbase 3030 and Yubase 4. Group V oils include Plastomoll DNA. A naphthenic oil is Shell Risella 907. PAO is a Group IV oil.

Without being limited to any particular theory, Applicants believe an interplay between the hydrocarbon base fluid polarity and the copolymer polarity result in a VI response indicating a difference in the polymer coiling-expansion ratio and may thus greatly affect viscosity index. When a polar polymer is subjected to a nonpolar solvent such as a Group III oil, the polar zones of the copolymer can associate at lower temperature and cause an increase in viscosity at 40° C. This increase in viscosity at 40° C. can result in a sharp decrease in the viscosity index of the fluid.

When an ester oil polar solvent is introduced, the polar ester oil molecules may interact with the polar zones of the copolymer and break up the associative thickening responsible for the increase in viscosity at lower temperature (i.e. the drop in viscosity index). As the polarity of the ester oil molecule increases, its ability to disrupt the association of the copolymer also increases. The general range of base oils polarity is as follows:

Group IV<Group III<Group II<Group I<Group V (ester oil)

Since a Group I fluid is more polar than a Group III fluid increased solubility of the polar copolymer in the Group I fluid may be expected. Interaction between the polar solvent and the polar segments of the polymer would be expected to disrupt the associative thickening. An even greater effect may be obtained with a Group V oil, such as a dialkyl dicarboxylic acid ester or an alkylmethacrylate. A dialkyl dicarboxylic acid ester such as diisononyl adipate (e.g. Plastomoll DNA) can much more strongly inhibit associative thickening and consequently provide a synergistic viscosity index boost according to the formulation of the present invention by reducing the viscosity of the lubricant at 40° C.

Not only hydrocarbon base oil polarity but polymer polarity may affect the interplay. As the polarity of the polymer increases (i.e. more polar monomer content), the VI can decrease. When ester oil is introduced, polar polymer-polymer associations (associative thickening) are effectively disrupted and the decrease in VI is minimized. When the polarity of the polymer decreases (i.e. less polar monomer content), the beneficial effect of the ester oil may not observed because less associative thickening is present. Therefore a marginal VI response would be obtained.

Conversely, when looking at polymers which are much less polar (e.g. low-polar/non-polar methacrylate copolymers, polyolefins etc.). The addition of ester oil to blends containing copolymers of low polarity would not benefit from a disruptive interaction and therefore a synergistic effect on the VI would not result.

Synthetic oils are, among other substances, poly alpha olefins, organic esters including carboxylic esters and phosphate esters; organic ethers including silicone oils and polyalkylene glycol; and synthetic hydrocarbons, especially polyolefins. They are for the most part somewhat more expensive than the mineral oils, but they have advantages with regard to performance. For an explanation, reference is made to the 5 API classes of base oil types (API: American Petroleum Institute).

American Petroleum Institute (API) Base Oil Classifications

| Base stock Group | Viscosity Index | Sulfur (weight %) | Saturates (weight %) |
|---|---|---|---|
| Group I | 80-120 | >0.03 | <90 |
| Group II | 80-120 | <0.03 | >90 |
| Group III | >120 | <0.03 | >90 |
| Group IV all synthetic Poly alpha olefins (PAO) | >120 | <0.03 | >99 |
| Group V all not included in Groups I-IV, e.g. esters, polyalkylene glycols | >120 | <0.03 | |

Among the Group IV synthetic hydrocarbons, polyolefins, in particular poly alpha olefins (PAO) are preferred. These compounds may be obtained by polymerization of alkenes, especially alkenes having 3 to 12 carbon atoms. Conventionally used alkenes include propene, hexene-1, octene-1, and dodecene-1. Preferred PAOs have a number average molecular weight in the range of 200 to 10000 g/mol, more preferably 500 to 5000 g/mol.

Preferred ester oil are Group V ester oils. The Group V ester oil may be present in the lubricant formulation in a range of percent by weight based on the total weight of the lubricant formulation of 0.5 to 80 percent by weight. The percent range includes all values and subvalues therebetween, especially including from 0.75 to 35 percent and most especially from 5 to 25 percent.

The Group V ester oil may be any ester oil which can be categorized as a Group V oil. Preferred ester oils are dialkyl dicarboxylic acid esters or alkyl methacrylate esters. The dialkyl dicarboxylic acid esters are especially preferred. Examples of dialkyl dicarboxylic acid esters include dialkyl adipates, dialkyl pimelates, dialkyl suberates, dialkyl azelates, dialkyl dodecanoates, dialkyl sebacates and dialkyl phthalates. Dialkyl adipates, dialkyl suberates and dialkyl sebacates are particularly preferred. The dialkyl portion of the esters may include esters based on isononyl alcohol, octyl alcohol, diethylhexylalcohol, neopentyl glycol, diethylene glycol, dipropylene glycol, trimethanol propane and pentaerythritol. Diisononyl adipate, dioctyl adipate, dioctyl sebacate and diethylhexyl sebacate are most particularly preferred.

The alkyl methacrylate esters are exemplified in the documents EP0471258, filed Aug. 3, 1991 at the European Patent Office having the application number 91113088.8, and EP0471266, filed Aug. 3, 1991 at the European Patent Office having the application number 91113123.3. The documents EP0471258 and EP0471266 are enclosed herein by reference.

The monomer mixtures described above can be polymerized by any known method. Conventional radical initiators can be used to perform a classic radical polymerization. These initiators are well known in the art. Examples for these radical initiators are azo initiators including but not limited to 2,2'-azodiisobutyronitrile (AIBN), 2,2'-azobis(2-methylbutyronitrile) and 1,1azobiscyclohexane carbonitrile; peroxide compounds, e.g. methyl ethyl ketone peroxide, acetyl acetone peroxide, dilauryl peroxide, tert.-butyl per-2-ethyl hexanoate, ketone peroxide, methyl isobutyl ketone peroxide, cyclohexanone peroxide, dibenzoyl peroxide, tert.-butyl perbenzoate, tert.-butyl peroxy isopropyl carbonate, 2,5-bis(2-ethylhexanoyl-peroxy)-2,5-dimethyl hexane, tert.-butyl peroxy 2-ethyl hexanoate, tert.-butyl peroxy-3,5,5-trimethyl hexanoate, dicumene peroxide, 1,1bis(tert. butyl peroxy)cyclohexane, 1,1bis(tert. butyl peroxy) 3,3,5-trimethyl cyclohexane, cumene hydroperoxide and tert.-butyl hydroperoxide.

Furthermore, novel polymerization techniques such as ATRP (Atom Transfer Radical Polymerization) and or RAFT (Reversible Addition Fragmentation Chain Transfer) can be applied to obtain the copolymers of the present invention. These methods are well known. The ATRP reaction method is described, for example, by J-S. Wang, et al., J. Am. Chem. Soc., Vol. 117, pp. 5614-5615 (1995), and by Matyjaszewski, Macromolecules, Vol. 28, pp. 7901-7910 (1995). Moreover, the patent applications WO 96/30421, WO 97/47661, WO 97/18247, WO 98/40415 and WO 99/10387 disclose variations of the ATRP explained above. The RAFT method is extensively presented in WO 98/01478, for example, to which reference is expressly made for purposes of the disclosure.

The polymerization can be carried out at normal pressure, reduced pressure or elevated pressure. The polymerization temperature is also not critical. However, conventionally the polymerization temperature may be in the range of −20-200° C., preferably 0-130° C. and especially preferably 60-120° C., without any limitation intended by this description.

The polymerization may be carried out with or without solvents; but is preferably carried out in a nonpolar solvent. These include hydrocarbon solvents, for example aromatic solvents such as toluene, benzene and xylene, saturated hydrocarbons, for example cyclohexane, heptane, octane, nonane, decane, dodecane, which may also be present in branched form. These solvents may be used individually and as a mixture. Particularly preferred solvents are mineral oils and synthetic oils (e.g. ester oils such as diisononyl adipate), and also mixtures thereof. Among these, very particular preference is given to mineral oils and ester oils.

According to a preferred embodiment, the copolymer may be obtained by a polymerization in API Group II or Group III mineral oil. These solvents are disclosed above.

According to another preferred embodiment the copolymer may be prepared in an ester oil, preferably diisononyl adipate.

The copolymer may be a mixture of copolymers as described and may be present in the lubricant formulation in a weight percent range relative to the total weight of the lubricant of from 0.5 to 40 percent. The percent range includes all values and subvalues therebetween, especially including from 1.0 to 35, 2 to 25, 5 to 20, 5 to 15 and 1.4 to 15 wt %.

Having generally described this invention, a further understanding can be obtained by reference to certain specific examples which are provided herein for purposes of illustration only, and are not intended to be limiting unless otherwise specified.

EXAMPLES

Effect of Combining a Group V Ester Oil with a Hydrocarbon Oil

The Viscosity Index of oils of Groups I, III and V are shown in Table 1. Mixtures of 5% by weight of the Group V oil in the Group I oil and in the Group III oil were prepared and the Viscosity Index of each mixture determined. The results are shown in Table 1.

TABLE 1

Viscosity Index of Base Oils.

| Base Oil | Viscosity Index |
|---|---|
| Group I | 106 |
| Group III | 124 |
| Group V | 144 |
| Group I + 5% Group V | 107 |
| Group III + 5% Group V | 125 |

As shown in Table 1, the Viscosity Index increases from Group I to Group V. In each mixture the effect of adding 5% Group V oil increases the Viscosity Index by 1 unit.

Synthesis Example

Copolymer 4

A round-bottom flask equipped with a glass stir rod, nitrogen inlet, reflux condenser and thermometer was charged with 78.7 g of Group II oil supplied by Petro-Canada, 537.54 g $C_{12}$-$C_{13}$ methacrylate, 211.49 g $C_{14}$-$C_{15}$ methacrylate, 130.20 g $C_1$ methacrylate. The mixture was heated up to 110° C. while stirring and nitrogen bubbling for inertion. Then 3-stage feed for 3 hours feed of a mixture consisting of 8.33 g tert-butyl peroctoate (tBPO) and 125.0 g Group II oil supplied by Petro-Canada was started. After the feed end the mixture was stirred for an addition 30 minutes. After the end of the polymerization the product was diluted with 170.0 g Petro-Canada Group II Oil.

Copolymer Examples 1, 3, and 6 were prepared by a similar method wherein the components were adjusted as described in Table 2.

Synthesis Example

Copolymer 5

A round-bottom flask equipped with a glass stir rod, nitrogen inlet, reflux condenser and thermometer was charged with 150.0 g of Group II oil supplied by Petro-Canada, 537.54 g $C_{12}$-$C_{13}$ methacrylate, 211.49 g $C_{14}$-$C_{15}$ methacrylate, 130.20 g $C_1$ methacrylate, 2.10 g CuBr, 2.50 g pentamethyldiethylenetriamine. The mixture was heated up to 80° C. while stirring and nitrogen bubbling for inertion. Then polymerization was initiated with 5.61 g Ethyl-2-bromoisobutyrate. Reaction temperature was increased to 95° C. and stirred for 8 hours. After the end of the polymerization the product was diluted with 235.0 g Group II oil supplied by Petro-Canada.

Copolymer Example 2 was prepared by a similar method wherein the components were adjusted as described in Table 2.

Comparative Example

Copolymer 7

Comparative copolymer example having the monomer composition shown in Table 2 was also prepared.

TABLE 2

| Examples | Polymer Data: 1 | 2 | 3 | 4 | 5 | 6 | 7 | 8 |
|---|---|---|---|---|---|---|---|---|
| | % | | | | | | | |
| C1 MA | 25 | 25 | 25 | 13 | 13 | 25 | — | — |
| C12-C13 MA | 54 | 54 | 54 | 62 | 62 | 20 | 42 | — |
| C14-C15 MA | 21 | 21 | 21 | 25 | 25 | 16 | 36 | |
| C16-C30 MA | — | — | — | — | — | 39 | 22 | — |
| Paratone 8451 | | | | | | | | 100 |
| Mw (kg/mol) | 29.0 | 37.9 | 29.0 | 27.1 | 36.9 | 29.7 | 80.0 | — |
| PDI | 1.76 | 1.29 | 1.76 | 1.72 | 1.28 | 1.78 | 2.00 | — |
| Chi parameter (Solubility, $\chi$) | 0.43 | 0.43 | 0.43 | 0.35 | 0.35 | 0.41 | 0.27 | |

Paratone 8451 is an olefin copolymer supplied by Chevron Oronite Co.

Synergistic Effect of Combination of Copolymer and Group V Oil

Preparation of Lubricating Oils

Blending Procedure for Examples 1, 4 and 8. A container was charged with 20.0 grams of polymer, 80.0 grams of Group III base oil supplied by SK Energy. The materials were stirred using a pitched blade stirrer on a hot plate at ca. 75° C. for 1 hour under air atmosphere.

Blending of Examples 1a, 4a, and 8a

Examples Using Ester Oil

A container was charged with 20.0 grams of polymer, 5.0 g of Group V oil supplied by BASF, and 75.0 grams of Group III base oil supplied by SK Energy. The materials were then stirred using an overhead stirrer equipped with a pitched blade at a stir rate of ca. 300 rpm.

Physical mixtures according to Table 3 were prepared and the kinematic viscosities at 40 and 100° C. measured. The Viscosity Index for each mixture was determined. The results are shown under the heading Group I in Table 3a. The results are shown in Table 3a under the heading Group I+Group V.

TABLE 3

| Examples | Group I Blend Composition 1 | 1a | 4 | 4a | 8 | 8a |
|---|---|---|---|---|---|---|
| | % | | | | | |
| Polymer | 14.2 | 14.2 | 14.2 | 14.2 | 14.2 | 14.2 |
| Group II Oil | 5.80 | 5.80 | 5.80 | 5.80 | 5.80 | 5.80 |
| Group V Oil | | 5.0 | | 5.0 | | 5.0 |
| Group I Oil | 80.0 | 75.0 | 80.0 | 75.0 | 80.0 | 75.0 |
| Total | 100.0 | 100.0 | 100.0 | 100.0 | 100.0 | 100.0 |

RMF 5 is a Group 1 mineral oil.

TABLE 3a

| Examples | 1 | 1a | 4 | 4a | 8 | 8a |
|---|---|---|---|---|---|---|
| KV100 (cSt) | 14.13 | 13.79 | 12.97 | 12.85 | 22.43 | 21.65 |
| KV40 (cSt) | 91.29 | 85.42 | 80.00 | 76.74 | 162.0 | 150.2 |
| VI | 159 | 166 | 163 | 169 | 166 | 170 |

As shown in Table 1 the difference in Viscosity Index (VI) of a mixture of the Group I oil and Group V oil only is 1 unit. When the copolymer from Table 2 was added to the Group I base oil the Viscosity Index increased to values of from 159 to 166 units as shown in Table 3a. The addition of the Group V oil further increased the Viscosity Index to 166-170 as shown in Table 3a. With the comparative composition containing copolymer 8 the VI difference was only 4 units when the Group V oil was added. However in the formulations according to the present invention, the improvement was 6 or more units. The higher VI of the Group V oil-containing formulation in example 8 can be explained as a result of the higher VI of the base fluid alone. A synergistic VI-improvement effect was not obtained. The mixtures according to the present invention containing copolymer examples 1 and 4, however, behaved very differently. Here the Group V oil-containing fluids showed significantly higher viscosity indices, with the VI improvement being 6 or more units. Such significant improvements can not be explained with slight VI-differences of the base fluid alone.

A similar set of experimental mixtures were prepared and viscosities evaluated using a Group III mineral oil. The relevant data is shown in Tables 4 and 4a.

TABLE 4

| Examples | Group III Blend Composition 1 | 1a | 2 | 2a | 3 | 3a | 4 | 4a |
|---|---|---|---|---|---|---|---|---|
| | % | | | | | | | |
| Polymer | 14.2 | 14.2 | 14.2 | 14.2 | 14.2 | 14.2 | 14.2 | 14.2 |
| Group II Oil | 5.80 | 5.80 | 5.80 | 5.80 | 5.80 | 5.80 | 5.80 | 5.80 |
| Group III Oil | 80.0 | 75.0 | 80.0 | 75.0 | 79.1 | 74.05 | 80.0 | 75.0 |
| Group V Oil | 0.0 | 5.0 | 0.0 | 5.0 | 0.0 | 5.0 | 0.0 | 5.0 |
| Hitec 521 | | | | | 0.95 | 0.95 | | |
| Total | 100.0 | 100.0 | 100.0 | 100.0 | 100.0 | 100.0 | 100.0 | 100.0 |
| Examples | 5 | 5a | 6 | 6a | 7 | 7a | 8 | 8a |
| | % | | | | | | | |
| Polymer | 14.2 | 14.2 | 14.2 | 14.2 | 13.2 | 13.2 | 20.0 | 20.0 |
| Group II Oil | 5.80 | 5.80 | 5.80 | 5.80 | 6.80 | 6.80 | | |
| Group III Oil | 80.0 | 75 | 80.0 | 75 | 80.0 | 75 | 80.0 | 75 |
| Group V Oil | | 5.0 | | 5.0 | | 5.0 | | 5.0 |
| Total | 100.0 | 100.0 | 100.0 | 100.0 | 100.0 | 100.0 | 100.0 | 100.0 |

Hitec 521 is a detergent inhibitor supplied by Afton Chemical.

TABLE 4a

| Examples | 1 | 1a | 2 | 2a | 3 | 3a | 4 | 4a |
|---|---|---|---|---|---|---|---|---|
| KV100 (cSt) | 10.36 | 10.36 | 12.54 | 12.53 | 10.33 | 10.26 | 9.871 | 9.735 |
| KV40 (cSt) | 53.90 | 51.90 | 70.56 | 67.26 | 54.41 | 51.90 | 48.99 | 47.18 |
| VI | 185 | 193 | 179 | 188 | 182 | 191 | 193 | 198 |
| Examples | 5 | 5a | 6 | 6a | 7 | 7a | 8 | 8a |
| KV100 (cSt) | 12.45 | 12.22 | 10.28 | 10.26 | 13.91 | 13.70 | 17.73 | 17.49 |
| KV40 (cSt) | 62.74 | 59.37 | 50.37 | 49.47 | 67.53 | 65.61 | 107.2 | 103.4 |
| VI | 201 | 209 | 198 | 202 | 215 | 217 | 183 | 186 |

As shown in Table 1 the difference in Viscosity Index (VI) of a mixture of the Group III oil and Group V oil only was 1 unit. When the copolymer from Table 2 was added to the Group III base oil the Viscosity Index increased to values of from 179 to 215 units as shown in Table 4. The addition of the Group V oil further increased the Viscosity Index to 188-217 as shown in Table 4. With the comparative compositions containing copolymer 7 and 8 respectively, the VI difference was only 3 units or less when the Group V oil was added. The higher VIs of the ester oil containing formulations with copolymers 7 and 8 was caused solely by the higher VI of the base fluid.

The mixtures according to the present invention containing copolymer examples 1-6, however, again behaved very differently. The Group V oil-containing fluids showed significantly higher viscosity indices increased by 5 or more units. Such significant improvements can not be explained with slight VI-differences of the base fluid alone.

TABLE 5

| Group III Blend Composition (Constant KV40) | | | | | | |
|---|---|---|---|---|---|---|
| Examples | 1 | 1a | 4 | 4a | 6 | 6a |
| | % | | | | | |
| Polymer | 12.43 | 12.78 | 13.85 | 14.02 | 13.21 | 13.4 |
| Group II Oil | 5.08 | 5.22 | 5.65 | 5.73 | 5.40 | 5.47 |
| Group III Oil | 82.50 | 77.00 | 80.50 | 75.25 | 81.39 | 76.13 |
| Group V Oil | 0.0 | 5.0 | 0.0 | 5.0 | 0.0 | 5.0 |
| Total | 100.0 | 100.0 | 100.0 | 100.0 | 100.0 | 100.0 |

TABLE 5a

| Examples | 1 | 1a | 4 | 4a | 6 | 6a |
|---|---|---|---|---|---|---|
| KV100 (cSt) | 9.150 | 9.320 | 9.540 | 9.560 | 9.654 | 9.822 |
| KV40 (cSt) | 45.20 | 45.03 | 45.89 | 45.49 | 46.49 | 46.53 |
| VI | 190 | 196 | 198 | 201 | 199 | 204 |

The addition of Group V oil to the blends according to the present invention generated a VI increase in both Group I and Group III oils. Overall, an increase of 5 to 9 VI units was obtained for copolymers comprising between 5% and 25% $C_1$-$C_4$ methacrylate in the copolymer composition respectively. The impact of Group V oil on the KV40 viscosity is seen clearly for all examples. As the polarity of the copolymer increases, VI loss can be minimized by using Group V oil to disrupt thickening due to polar polymer association. As the amount of MMA in the polymer is reduced, the polarity decreases, thus minimizing the beneficial effect of the Group V oil to increase VI.

Synthesis Example 14

A double jacket reactor heated with oil circulation and equipped with a blade stirrer, nitrogen inlet, reflux condenser and thermometer was charged with 2688.0 g of hPBD-$MM_{4800}$ (methacrylic ester of hydrogenated hydroxyl terminated polybutadiene having a number average molecular weight of 4800), 1152.0 g $C_4$ methacrylate, 2560.0 g Styrene, 2773.2 g Naphthenic oil supplied by Shell Chemical Co. and 1493.2 g of a Group I mineral oil (100N-oil). The mixture was heated up to 120° C. while stirring and nitrogen bubbling for inertion, then an initiator of 0.42 g tBPO was added. Following the addition, a 3 hour feed of a mixture consisting of 15.36 g tBPO and 35.84 g Group III mineral oil supplied by Neste Oil was started. 1 hour and 4 hours after the feed end, each 12.8 g of 2,2-bis(tert-butylperoxy)butane (BtBPOP) were added to fully convert the charged monomers. After the end of the polymerization the product was diluted with 5297.2 g Group III mineral oil supplied by Neste Oil, thoroughly mixed and drained. 16 kg of a clear and viscous solution were obtained.

Examples 9-13 were prepared by a similar method wherein the monomer compositions were adjusted as described in Table 6.

TABLE 6

| | Polymer Data | | | | | |
|---|---|---|---|---|---|---|
| Examples | 9 | 10 | 11 | 12 | 13 | 14 |
| | % | | | | | |
| C1 MA | 37.8 | 35.5 | 29.8 | 23.8 | 17.8 | — |
| C4 MA | 20.2 | 23.5 | 29.8 | 36.3 | 39.8 | 18.00 |
| C12-C15 MA | 0.18 | 0.18 | 0.18 | 0.18 | 0.18 | — |
| C16-C20 MA | 0.02 | 0.02 | 0.02 | 0.02 | 0.02 | — |
| C100-C350 MA | 41.60 | 40.60 | 40.00 | 39.50 | 42.00 | 42.00 |
| Styrene | 0.20 | 0.20 | 0.20 | 0.20 | 0.20 | 40.00 |
| Mw (kg/mol) | 84.0 | 130.0 | 152.0 | 124.0 | 160.0 | 193.0 |
| PDI | 2.99 | 3.02 | 3.04 | 2.81 | 2.88 | 4.01 |

Blending Procedure

Examples 9-14

All fluids had been adjusted to the same kinematic viscosity of 20 $mm^2/s$, measured at 40° C. (KV40=20 $mm^2/s$).

Viscosity measurements were done according to ASTM D 445. All measurements were done in presence of a detergent-inhibitor package consisting of dispersants, anti oxidants, antiwear additives and extreme-pressure additives, rust inhibitors and seal swellants.

The polymers were blended in two different fluids. Fluid 1 consisted of a pure hydroisomerized base stock, having a KV100 of ~3.0 $mm^2/s$ and a commercially available DI package. The blend of oil+DI had a KV100=3.394 $mm^2/s$, KV40=14.09 $mm^2/s$ and a viscosity index of 115.

Fluid 2 was made of 67% of the same hydroisomerized base stock with DI and 33% of a blend consisting of polar ester oil with DI. The blended fluids had a KV100=3.003 $mm^2/s$, KV40=11.27 $mm^2/s$ and a viscosity index of 124.

The composition and viscosity data for Examples 9-14 are shown in Table 7.

TABLE 7

| Examples | 9 | 9a | 10 | 10a | 11 | 11a |
|---|---|---|---|---|---|---|
| | % | | | | | |
| Polymer | 6.00 | 8.24 | 3.60 | 5.44 | 2.80 | 4.88 |
| Group I Oil | 1.35 | 1.86 | 0.81 | 1.22 | 0.63 | 1.10 |
| Naphthenic Oil | 2.61 | 3.58 | 1.57 | 2.37 | 1.22 | 2.12 |
| Group III Oil | 5.04 | 6.92 | 3.02 | 4.57 | 2.35 | 4.10 |
| Group V Oil | | 26.20 | | 28.51 | | 28.97 |
| Group III Oil | 85.00 | 53.20 | 91.00 | 57.89 | 93.00 | 58.83 |
| Total | 100.0 | 100.0 | 100.0 | 100.0 | 100.0 | 100.0 |
| Examples | 12 | 12a | 13 | 13a | 14 | 14a |
| | % | | | | | |
| Polymer | 3.28 | 4.64 | 2.76 | 4.00 | 3.20 | 2.92 |
| Group II Oil | 0.74 | 1.04 | 0.62 | 0.90 | 0.72 | 0.66 |
| Group III Oil | 1.43 | 2.02 | 1.20 | 1.74 | 1.39 | 1.27 |
| | 2.76 | 3.90 | 2.32 | 3.36 | 2.69 | 2.45 |
| | | 29.17 | | 29.70 | | 30.59 |
| Group V Oil | 91.80 | 59.23 | 93.10 | 60.30 | 92.00 | 62.11 |
| Total | 100.0 | 100.0 | 100.0 | 100.0 | 100.0 | 100.0 |

TABLE 7a

| Examples | 9 | 9a | 10 | 10a | 11 | 11a |
|---|---|---|---|---|---|---|
| KV100 (cSt) | 4.712 | 5.481 | 4.711 | 5.526 | 4.505 | 5.636 |
| KV40 (cSt) | 19.65 | 19.89 | 19.83 | 20.49 | 19.94 | 20.24 |
| VI | 169 | 238 | 166 | 231 | 146 | 245 |
| Examples | 12 | 12a | 13 | 13a | 14 | 14a |
| KV100 (cSt) | 4.602 | 5.714 | 4.723 | 5.890 | 5.407 | 5.561 |
| KV40 (cSt) | 19.74 | 19.60 | 19.73 | 20.11 | 19.70 | 19.79 |
| VI | 158 | 265 | 170 | 270 | 236 | 247 |

The tables 7 and 7a clearly show the synergistic effect between polymers containing polar comonomers, and polar ester oils in terms of VI-lift of the finished fluid. The VI improvement of the fluids with example 14, which contains no highly polar comonomer such as MMA, can be seen, but is not pronounced. The MMA containing polymers show an astonishing VI improvement. Here the ester oil containing fluids show significantly higher viscosity indices, sometimes the VI-advantage exceeds more than 100 points.

Improvements in VI were achieved with as little as 0.5% Group V oil. As much as 80% Group V oil has been added without observing any plateau effect of the viscosity index for the 25% MMA containing copolymer. The slope of the increase in VI appears to be steeper for the more polar viscosity modifier (Example 1), than for the less polar viscosity modifier (Example 4), suggesting that polymer composition in conjunction with the base fluid work together to provide the most beneficial VI response. As the solubility parameter, $\chi$, is greater, the change in viscosity becomes greater.

Using a polar polymer alone did not result in an appreciable viscosity index increase alone. The use of small amounts of higher viscosity index base oils alone did not result in a higher viscosity index of the final lubricating oil. However when the polarity of the polymer and polarity of the base fluid were optimized, there was a synergistic effect which increased the viscosity index of the final lubricating oil higher than each of the two independent methods.

TABLE 8

Reference Table.

| Base Oil | KV100 (cSt) | KV40 (cSt) | VI |
|---|---|---|---|
| Plastomoll DNA | 3.01 | 10.73 | 144 |
| RMF 5 | 5.42 | 31.62 | 106 |
| 5% Plastomoll in RMF 5 | 5.20 | 29.36 | 107 |
| Yubase 4 | 4.32 | 20.08 | 124 |
| 5% Plastomoll in Yubase 4 | 4.16 | 18.81 | 125 |
| Nexbase 3030 | 3.39 | 14.09 | 115 |
| 33% Plastomoll in Nexbase 3030 | 3.00 | 11.27 | 124 |

Viscosity Measurement

The viscosity index of the fluids was calculated from the measured kinematic viscosities at 100° C. and 40° C. using a Cannon Automated Viscometer (CAV-2100) manufactured by the Cannon Instrument Company using the known equations. Viscosity measurements were performed according to ASTM D 445.

The invention claimed is:

1. A lubricant, comprising:

5.0 wt. % of an ester oil;

a hydrocarbon oil selected from the group consisting of a mineral oil of Group I, II and III;

and 12.78 to 14.2 wt % of a polyalkyl(meth)acrylate copolymer having a weight average molecular weight of from 25,000 to 160,000, the copolymer comprising, in copolymerized form, a) 13 to 25 wt % based on a total weight of the polyalkyl (meth)acrylate copolymer of units of one or more alkyl(meth)acrylate monomers of formula (I):

(I)

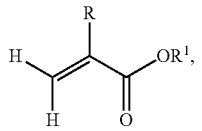

wherein

R is hydrogen or methyl, and $R^1$ is a linear, branched or cyclic alkyl residue with 1 to 4 carbon atoms;

b) 36 to 87 wt % based on a total weight of the polyalkyl (meth)acrylate copolymer of units of one or more alkyl(meth)acrylate monomers of formula (II):

(II)

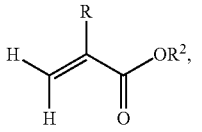

wherein

R is hydrogen or methyl, and $R^2$ is a linear, branched or cyclic alkyl residue with 5 to 15 carbon atoms; and c) 0 to 39 wt % based on a total weight of the polyalkyl (meth)acrylate copolymer of units of one or more alkyl(meth)acrylate monomers of formula (III):

(III)

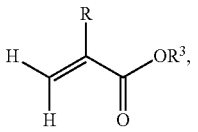

wherein

R is hydrogen or methyl, $R^3$ is a linear, branched or cyclic alkyl residue with 16 to 400 carbon atoms; and d) units of comonomers.

2. The lubricant of claim 1, wherein a weight ratio of the polyalkyl(meth)acrylate copolymer to the ester oil is in a range of 2.5:1 to 2.8:1.

3. The lubricant of claim 1, wherein the ester oil is selected from the group consisting of a dicarboxylic acid ester and mixtures thereof.

4. The lubricant of claim 1, wherein the ester oil is selected from the group consisting of a di-alkyl-adipate and mixtures thereof.

5. The lubricant of claim 1, wherein the ester oil is selected from the group consisting of a dialkyl substituted sebacate and mixtures thereof.

6. The lubricant of claim 1, wherein the polyalkyl(meth) acrylate copolymer is obtained in the presence of at least one of the ester oil and the hydrocarbon oil.

7. The lubricant of claim 1, wherein the polyalkyl(meth) acrylate copolymer is obtained in the presence of the ester oil.

8. The lubricant of claim 1, wherein the ester oil is a dialkyl dicarboxylate, an alkyl(meth)acrylate, or a mixture thereof.

9. The lubricant of claim 8, wherein the ester oil is a dialkyl dicarboxylate and the dialkyl dicarboxylate is at least one selected from the group consisting of a dialkyl adipate, a dialkyl pimelate, a dialkyl suberate, a dialkyl azelate, a dialkyl sebacate, and mixtures thereof.

10. The lubricant of claim 1, wherein the polyalkyl(meth) acrylate copolymer has a polydispersity in the range of 1.05 to 2.0.

11. A method for preparing a lubricant, the method comprising:

polymerizing a monomer mixture in the presence of at least one of an ester oil and a hydrocarbon oil; the monomer mixture comprising, a) 13 to 25 wt % of one or more alkyl(meth)acrylate monomers of formula (I):

(I)

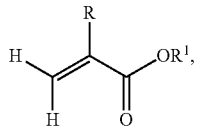

wherein

R is hydrogen or methyl, and $R^1$ is a linear, branched or cyclic alkyl residue with 1 to 4 carbon atoms;

b) 36 to 87 wt % of one or more alkyl(meth)acrylate monomers of formula (II):

(II)

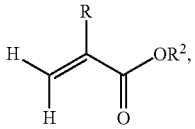

wherein

R is hydrogen or methyl, and $R^2$ is a linear, branched or cyclic alkyl residue with 5 to 15 carbon atoms; and c) 0 to 39 wt % of one or more alkyl(meth)acrylate monomers of formula (III):

(III)

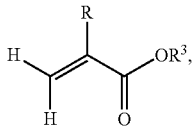

wherein

R is hydrogen or methyl, $R^3$ is a linear, branched or cyclic alkyl residue with 16 to 400 carbon atoms; and d) units of comonomers;

wherein a weight average molecular weight of the polyalkyl(meth) acrylate copolymer is from 25,000 to 160,000, and the hydrocarbon oil is selected from the group consisting of a mineral oil of Group I, II and III.

* * * * *